US007159286B1

(12) United States Patent
Shaw

(10) Patent No.: US 7,159,286 B1
(45) Date of Patent: Jan. 9, 2007

(54) FETAL BUNTING

(76) Inventor: Zellna Shaw, 501 W. Thigpen St., Lakeland, GA (US) 31635

( * ) Notice: Subject to any disclaimer, the term of this patent is extended or adjusted under 35 U.S.C. 154(b) by 0 days.

(21) Appl. No.: 11/289,825

(22) Filed: Nov. 30, 2005

Related U.S. Application Data

(60) Provisional application No. 60/631,641, filed on Sep. 16, 2005.

(51) Int. Cl.
*A61G 17/00* (2006.01)

(52) U.S. Cl. ..... 27/1; 27/21.1

(58) Field of Classification Search ..... 27/1, 27/28, 21.1; 150/147–149, 138, 143; 206/496, 206/37, 19, 784
See application file for complete search history.

(56) References Cited

U.S. PATENT DOCUMENTS

| | | | | |
|---|---|---|---|---|
| 2,704,101 | A * | 3/1955 | Wittrien | 206/37.4 |
| 3,970,130 | A * | 7/1976 | Casey | 150/149 |
| 5,636,742 | A * | 6/1997 | Hoffrichter | 206/494 |
| 2004/0088839 | A1* | 5/2004 | Maclean et al. | 27/21.1 |

* cited by examiner

*Primary Examiner*—William L. Miller
(74) *Attorney, Agent, or Firm*—Brian D. Bellamy

(57) ABSTRACT

A fetus bunting having a leakproof container, and an aesthetically appealing folding pouch with interior chamber accessible via a slit situated about midway along one side of the unfolded pouch. The interior chamber receives the leakproof container, and the pouch folds to conceal the container and provide a garment for the fetus. A auxiliary ribbon centrally attached to the side of the unfolded pouch that opposite the slit is used to decorate the bunting or hold the bunting in the folded configuration.

4 Claims, 2 Drawing Sheets

Fig. 2A
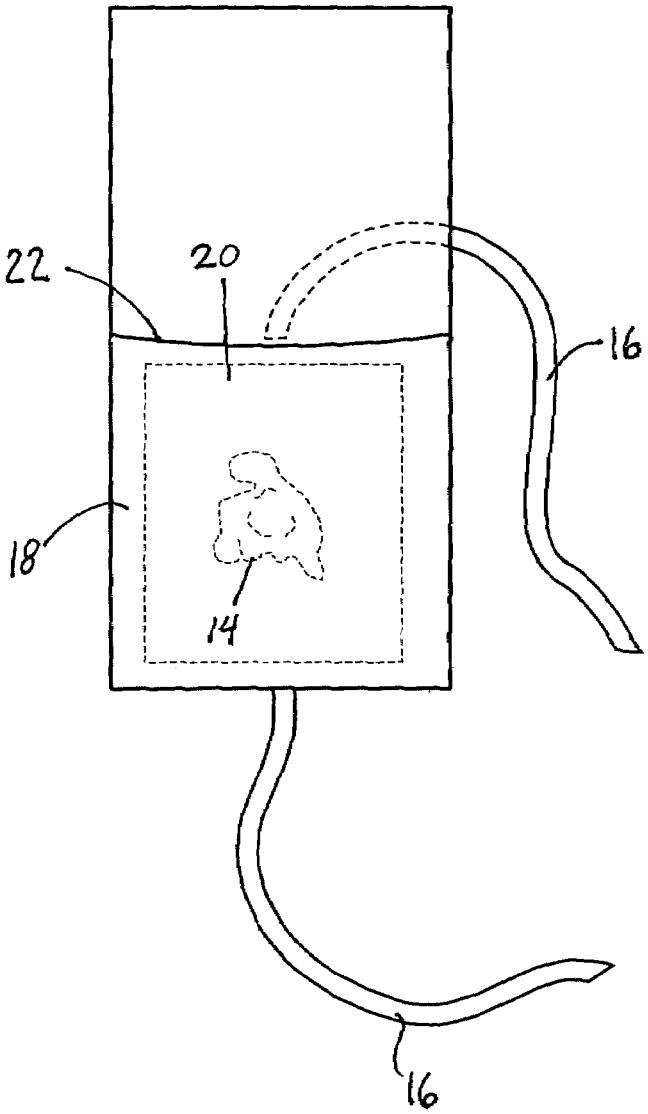
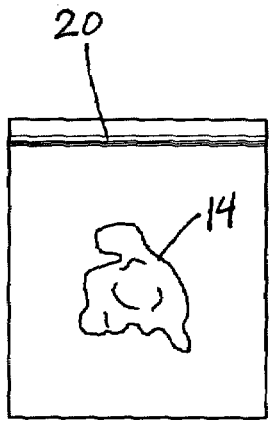
Fig. 2B

FETAL BUNTING

The present application claims benefit of U.S. provisional application No. 60/631,641 filed on Sep. 16, 2005.

BACKGROUND OF THE INVENTION

The present invention relates to a garment for an infant that predeceases normal birth such as by miscarriage.

Early during pregnancy many mothers and other persons form loving bonds with unborn children, even while the child remains a fetus in the mother's womb. Life is fragile and, unfortunately, some infant children predecease normal birth while still a fetus in the mother's womb because of miscarriage, disease, accident, homicide or abortion. Sometimes a mother, father, or other emotionally attached person desires to hold the deceased fetus after it is removed or delivered from the womb, and at times a proper ceremony or burial may be desired to celebrate the child's short existence and mourn the loss of the child.

Undoubtedly, various make-shift arrangements have been used to provide a fetal garment. These make-shift arrangements have likely included blanket, towel or cloth wraps and a variety of bags that were intended for other purposes. Make-shift arrangements usually allow very little time for preparation, design and craftsmanship and may be considered somewhat haphazard. The same persons who love a fetus and desire to hold or mourn the loss of the child would also prefer a specially designed and carefully constructed garment for the fetus. Thus, a need exists for a garment to be worn by a deceased fetus so that the fetus can be held or dressed for ceremony and final placement.

SUMMARY OF THE INVENTION

The invention provides a fetal infant bunting especially designed to hold a deceased fetus so that the fetus can be clothed in a garment after delivery or removal from a mother's womb. A fetus is much smaller than a fully developed newborn infant, and a fetus is undeveloped and sometimes moist from biological fluids. The bunting includes a plastic leakproof container such as a zip locking bag that is large enough to cozily contain the fetus in the container or a portion of the container. The leakproof container, as a whole or folded, fits within a portion comprising one-half of a fabric pouch formed of soft material that is decorative and soft to provide a level of elegance required by a discerning person desirous of comfort for themselves and quality that symbolically implies loving regards and blessing for the deceased fetus.

Because the deceased fetus is undeveloped, the fetus is unpleasant for some persons to look at. Therefore, the fabric pouch containing the leakproof container completely conceals the container and is generally opaque so that the deceased fetus is completely covered and cannot be seen once placed in the bunting. Unfolded, the pouch includes a slip at the midpoint of one side of the bunting. The slit provides access to the interior of the pouch toward one or both ends. The leakproof container fits through the slit and into the interior of the pouch on one end. The pouch folds near the midline formed by the slit to form a rectangular bunting about 6–10 inches in length and width. A ribbon is attached on the side of the bunting opposite the slit. Once the leakproof container is inserted into the fabric pouch and the pouch folded, the ribbon is tied to secure the bunting about the fetus.

DETAILED DESCRIPTION OF THE DRAWINGS

FIG. 2A is a frontal plan view of the unfolded fetal bunting of the invention.

FIG. 2B is a frontal plan view of the leakproof container of the invention shown with a fetus contained therein.

DETAILED DESCRIPTION OF THE INVENTION

Figure 1:
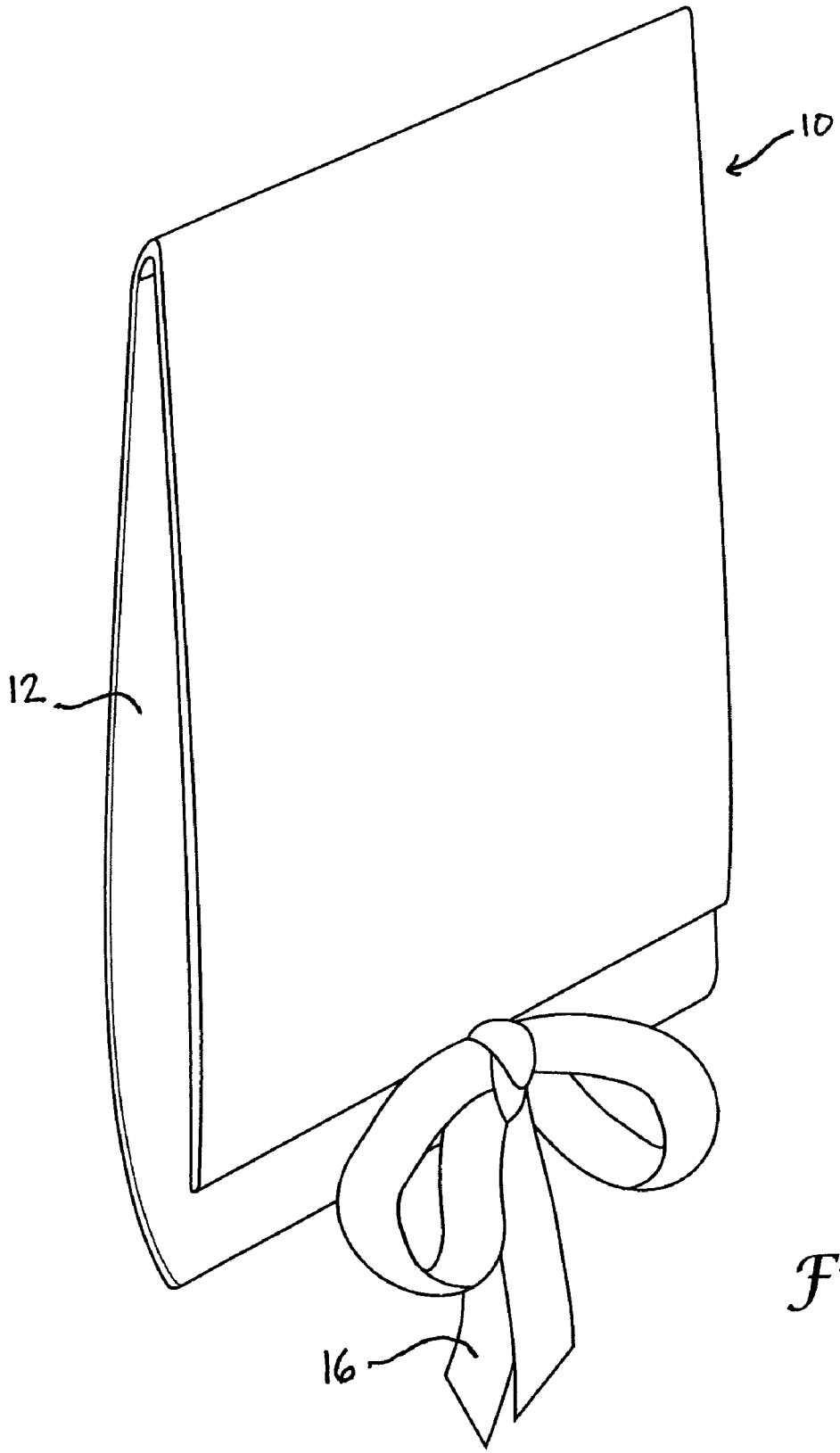
FIG. 1 is a perspective view of the fetal bunting constructed in accordance with the teachings of the present invention.

Referring to the figures, an embodiment of a fetal bunting 10 is shown in accordance with the invention. The fetal bunting 10 includes a pouch 12 constructed of decorative fabric that folds as shown in FIG. 1 to form a garment for a fetus 14 that can be easily held with the fetus contained therein. As illustrated in FIG. 1, the folded bunting 10 includes a ribbon 16 that may function as a decorative feature as shown or tied about the bunting pouch 12 to hold the pouch closed.

As illustrated in FIG. 2A, the pouch 12 includes one or more interior chambers 18 for holding the fetus 14. In FIG. 2A an interior chamber 18 is shown holding the fetus 14 within a zip locking bag 20 that fits easily within the chamber. The zip locking bag 20 is preferably leak proof to prevent leakage of biological fluids or preservative fluids from the surface of the fetus 14. Usually, the bag 20 will be constructed of plastic and may be purchased from present manufacturers making suitable bags. A detailed view of the bag 20 is shown in FIG. 2B.

The pouch 12 may be constructed from a single elongate rectangular fabric blank having an interior sideand an exterior side. The ends of the fabric blank are folded overlapping and meeting at the center of the blank on one side, which is the interior side of the pouch. Opposing side edges of the blank are sewn to form the interior chamber 18 shown in the figure while leaving a slit 22 for insertion of the bag. An additional interior chamber may be formed by sewing only the side edges of the overlapping blank on the opposing end, or this end may be sewn on three edges to completely close the layered section of material. The second interior chamber may be used to hold a twin sibling fetus that is also lost concurrently. Additional chambers may be provided by sizing the pouch accordingly and sewing an intermediate seam along the layered fabric perpendicular to the slit 22.

The ribbon 16 is attached at about the center of the unfolded fabric on the side of the pouch 12 opposing the slitted opening 22, which is the exterior side of the pouch. The ribbon 16 should be of ample length to wrap around the folding bunting 10 and tie the bunting closed or to form a bow at the bottom of the folded bunting for decoration.

While the present detailed description describes a preferred embodiment of the invention, there will be a variety of obvious variations to those skilled in the art, and the scope of the invention and included variations should be interpreted in accordance with the following claims.

The invention claimed is:

1. A fetus bunting comprising:

a. a leakproof container;

b. a folding pouch of suitable size for a deceased fetus having an exterior side and an interior side adjoined to define at least one interior chamber;

c. the interior side having an elongate slit about the midway point of the interior side for receiving the leakproof container with the deceased fetus into the interior chamber; and d. an auxiliary member for holding the pouch in a folded configuration or decorating the pouch.

2. A fetus bunting as in claim 1 in which the leakproof container consists of a zip locking plastic bag.

3. A fetus bunting as in claim 1 in which the folding pouch is at least partially constructed of cotton.

4. A fetus bunting as in claim 1 in which the auxiliary member comprises a ribbon centrally attached to the exterior side of the pouch.

* * * * *